US010043483B2

(12) United States Patent
Song et al.

(10) Patent No.: US 10,043,483 B2
(45) Date of Patent: Aug. 7, 2018

(54) PIXEL ARRANGEMENT STRUCTURE, ARRAY SUBSTRATE, DISPLAY APPARATUS AND DISPLAY CONTROL METHOD

(71) Applicant: BOE TECHNOLOGY GROUP CO., LTD., Beijing (CN)

(72) Inventors: Danna Song, Beijing (CN); Song Meng, Beijing (CN); Cuili Gai, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/320,649

(22) PCT Filed: Mar. 15, 2016

(86) PCT No.: PCT/CN2016/076372
§ 371 (c)(1),
(2) Date: Dec. 20, 2016

(87) PCT Pub. No.: WO2016/169359
PCT Pub. Date: Oct. 27, 2016

(65) Prior Publication Data

US 2017/0200428 A1 Jul. 13, 2017

(30) Foreign Application Priority Data

Apr. 22, 2015 (CN) ..... 2015 1 0192569

(51) Int. Cl.
*G09G 5/02* (2006.01)
*G09G 3/20* (2006.01)
*G09G 5/00* (2006.01)

(52) U.S. Cl.
CPC ..... *G09G 5/02* (2013.01); *G09G 5/003* (2013.01); *G09G 2300/0452* (2013.01); *G09G 2300/0465* (2013.01)

(58) Field of Classification Search
CPC ..... G09G 3/2983; G09G 3/3607
See application file for complete search history.

(56) References Cited

U.S. PATENT DOCUMENTS

2005/0018114 A1* 1/2005 Park ..... G02F 1/133555 349/114
2005/0068477 A1* 3/2005 Shin ..... G02F 1/133514 349/106

(Continued)

FOREIGN PATENT DOCUMENTS

CN 101000740 A 7/2007
CN 103811525 A 5/2014

(Continued)

OTHER PUBLICATIONS

Chinese First Office Action for Chinese Application No. 201510192569.7, dated Nov. 17, 2015, 7 Pages.

(Continued)

*Primary Examiner* — William Lu
(74) *Attorney, Agent, or Firm* — Brooks Kushman P.C.

(57) ABSTRACT

The present disclosure discloses a pixel arrangement structure, an array substrate, a display apparatus and a display control method. The display control method includes obtaining a first grayscale value, a second grayscale value, a third grayscale value and a fourth grayscale value of a blue sub-pixel of four pixel units in a repeating unit; and calculating an actual display value of the blue sub-pixel based on the first grayscale value, the second grayscale value, the third grayscale value and the fourth grayscale value.

6 Claims, 3 Drawing Sheets

(56) References Cited

U.S. PATENT DOCUMENTS

| | | | | |
|---|---|---|---|---|
| 2005/0128224 | A1* | 6/2005 | Baek | G09G 5/02 345/690 |
| 2008/0170083 | A1* | 7/2008 | Han | G09G 5/377 345/589 |
| 2011/0260951 | A1* | 10/2011 | Hwang | G02F 1/134336 345/55 |
| 2012/0139965 | A1* | 6/2012 | Yang | G09G 3/3225 345/690 |
| 2012/0256938 | A1 | 10/2012 | So | |
| 2015/0099322 | A1 | 4/2015 | Park et al. | |

FOREIGN PATENT DOCUMENTS

| | | | |
|---|---|---|---|
| CN | 104464541 | A | 3/2015 |
| WO | 2012138790 | A1 | 10/2012 |

OTHER PUBLICATIONS

International Search Report and Written Opinion for Application No. PCT/CN2016/076372, dated Mar. 15, 2016, 11 Pages.

* cited by examiner

PIXEL ARRANGEMENT STRUCTURE, ARRAY SUBSTRATE, DISPLAY APPARATUS AND DISPLAY CONTROL METHOD

CROSS-REFERENCE TO RELATED APPLICATIONS

This application is the U.S. national phase of PCT Application No. PCT/CN2016/076372 filed on Mar. 15, 2016, which claims priority to Chinese Patent Application No. 201510192569.7 filed on Apr. 22, 2015, the disclosures of which are incorporated in their entirety by reference herein.

TECHNICAL FIELD

The present disclosure relates to the field of display technology, in particular to a pixel arrangement structure, an array substrate, a display apparatus and a display control method.

BACKGROUND

Currently, a display screen usually uses primary colors, i.e., red, green, and blue (RGB) to display full-color images. The human eye has the nerve units for receiving the three colors, which are called cone cells. Three kinds of cone cells have different light sensitivities, which are sensitive to different wavelengths of light. For red light, green light, and blue light, the number of cone cells that receive red light is slightly more than that of cone cells that receive green light, and the number of cone cells that receive blue light is very small. In addition to the cone cells, the human eye also has the night vision unit to receive monochromatic light, which are called rod cells.

FIG. 1 is a schematic view of an RGB stripe arrangement according to the related art. As shown in FIG. 1, the RGB pixels are arranged in stripes, and one display point (unit) consists of three sub-pixels. Although the RGB pixels have identical spatial frequency in such pixel arrangement, the display screen with such pixel arrangement does not correspond to the human vision system very well. In addition, such pixel arrangement cannot display an image of a same quality by using a smaller number of sub-pixels without affecting the visual perception of the observer.

There is not an effective solution to solve the technical issue hereinabove.

SUMMARY

An object of the present disclosure is to provide a technical solution to display an image with a smaller number of sub-pixels without lowering the display quality of the image and without affecting the visual perception of the observer.

In order to achieve the above object, the present disclosure provides in some embodiments a pixel arrangement structure, an array substrate, a display apparatus and a display control method.

In one aspect, the present disclosure provides a pixel arrangement structure, including a plurality of repeating units. Each repeating unit comprises four pixel units comprising four red sub-pixels, four green sub-pixels and one blue sub-pixel, and each pixel unit comprises one red sub-pixel, one green sub-pixel and ¼ blue sub-pixel. The blue sub-pixel is located at a center region of each repeating unit and surrounded by the red sub-pixels and the green sub-pixels; each red sub-pixel is adjacent to at least one green sub-pixel and each green sub-pixel is adjacent to at least one red sub-pixel; and an area of the ¼ blue sub-pixel is smaller than that of each of the red sub-pixels and the green sub-pixels.

Optionally, in each of the repeating units, the red sub-pixels and the green sub-pixels are arranged in two rows and four columns.

Optionally, the blue sub-pixel is arranged at a position corresponding to two middle columns of the four columns.

Optionally, the sub-pixels in a first row comprise, in order, a red sub-pixel, a green sub-pixel, a red sub-pixel and a green sub-pixel; and the sub-pixels in a second row comprise, in order, a green sub-pixel, a red sub-pixel, a green sub-pixel and a red sub-pixel.

Optionally, the sub-pixels in a first row comprise, in order, a red sub-pixel, a green sub-pixel, a green sub-pixel and a red sub-pixel; and the sub-pixels in a second row comprise, in order, a green sub-pixel, a red sub-pixel, a red sub-pixel and a green sub-pixel.

Optionally, the sub-pixels in a first row comprise, in order, a red sub-pixel, a green sub-pixel, a green sub-pixel and a red sub-pixel; and the sub-pixels in a second row comprise, in order, a red sub-pixel, a green sub-pixel, a green sub-pixel and a red sub-pixel.

Optionally, the sub-pixels in a first row comprise, in order, a green sub-pixel, a red sub-pixel, a red sub-pixel and a green sub-pixel; and the sub-pixels in a second row comprise, in order, a green sub-pixel, a red sub-pixel, a red sub-pixel and a green sub-pixel.

Optionally, the red sub-pixel and the green sub-pixel in each pixel unit form an L-shaped sub-pixel group.

Optionally, the L-shaped sub-pixel group of each pixel unit is arranged adjacent to two adjacent sides of the ¼ blue sub-pixel; and the blue sub-pixel is located within a region enclosed by the L-shaped sub-pixel groups of the four pixel units of each repeating unit.

Optionally, in each L-shaped sub-pixel group, a length of one sub-pixel in a column direction is equal to a sum of a length of the other sub-pixel in a column direction, a length of the ¼ blue sub-pixel in the column direction and a distance between the other sub-pixel and the ¼ blue sub-pixel in the column direction.

In another aspect, the present disclosure provides an array substrate, including the above mentioned pixel arrangement structure.

In still another aspect, the present disclosure provides a display apparatus, including the above mentioned array substrate.

In still another aspect, the present disclosure provides a display control method, which includes steps of: obtaining a first grayscale value, a second grayscale value, a third grayscale value and a fourth grayscale value of a blue sub-pixel of four pixel units in a repeating unit; and calculating an actual display value of the blue sub-pixel based on the first grayscale value, the second grayscale value, the third grayscale value and the fourth grayscale value.

Optionally, the step of calculating an actual display value of the blue sub-pixel based on the first grayscale value, the second grayscale value, the third grayscale value and the fourth grayscale value includes: calculating an average grayscale value of the first grayscale value, the second grayscale value, the third grayscale value and the fourth grayscale value as the actual display value of the blue sub-pixel.

Compared with the related art, according to the pixel arrangement structure, the array substrate, the display apparatus and the display control method of the present disclosure, it is able to reduce the number of blue sub-pixels, so as to display the whole image with sharing the blue sub-pixel by the adjacent red sub-pixels and green sub-pixels. Since the human vision system is the least sensitive to the blue sub-pixel, the visual perception of the observer will not be affected. Therefore, it is able to display an image with a smaller number of physical sub-pixels without lowering the display quality of the image.

DETAILED DESCRIPTION

Figure 1:
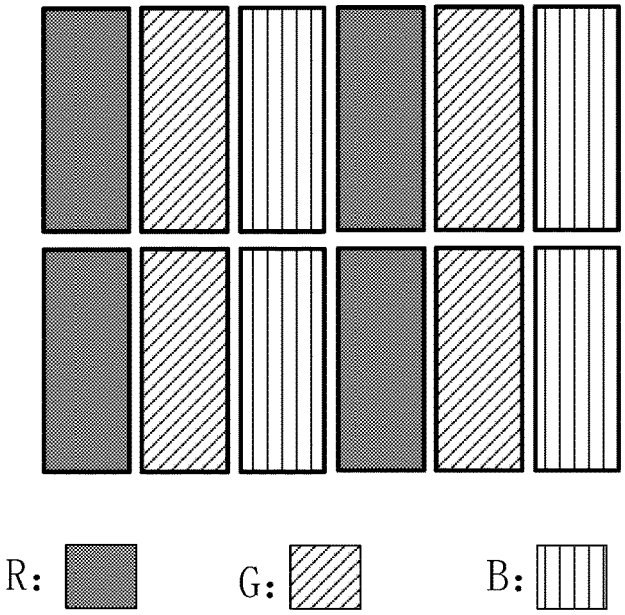
FIG. 1 is a schematic view of an RGB stripe arrangement according to the related art.

In order to make the objects, the technical solutions and the advantages of the present disclosure more apparent, the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

The Human Vision System (HVS) processes the information indicating luminance, chroma and motion status, where the motion status only affects a threshold of light flicker, a sensing of luminance for human eyes, i.e., a luminance channel of human eyes, is achieved by red and green receiving units of the HVS without sensing a color difference, and information from the red and green light receiving units may be strengthened by the luminance channel. A capability of luminance resolution of the HVS is several times stronger than a capability of chroma resolution thereof. The contribution of the blue light receiving unit for luminance sensing can be ignored. Actually, most observers will not perceive when the number of blue sub-pixels is reduced by ⅛. Human eyes mix different colors displayed by discrete sub-pixels together and perceive the same as a blended color, and also mix and perceive the colors within a certain angle. This angle is 0.25 degrees for blue and 0.12 degrees for both red and green. When a distance between an observer and a screen is 12 inches, a distance on the screen corresponding to 0.25 degrees is 1270 um and a distance on the screen corresponding to 0.12 degrees is 625 um. Assuming that the observation distance is constant, if a pixel distance between the red sub-pixel and the green sub-pixel is smaller than 625 um and a pixel distance between the blue sub-pixels is equal to 1270 um, then human eyes will mix colors without perceiving a loss of image quality.

Currently, in order to improve the resolution of a display screen, many manufacturers use the color gamut mapping algorithm (GMA) and sub-pixel rendering (SPR) technology to further improve the actual clarity and detailness of the display image. For the sub-pixel rendering (SPR), the simplest way is to make the luminance that sub-pixels display to be approximately equal to the sum of the luminance that the human eyes channel can perceive from the multiple pixels, so that the sub-pixels are used as sampling image reconstruction points, instead of the physical pixel that is formed by three pixels previously. The use of SPR can increase the spatial sampling frequency.

Since the HVS has a weaker capability of luminance resolution for the blue sub-pixels, when the number of blue sub-pixels is reduced, the observer will not perceive.

Based on the above, a pixel arrangement solution is provided in the present disclosure provides, by which the observer may not perceive any loss of the display image quality when the number of blue sub-pixels is reduced, and adjacent red sub-pixels and green sub-pixels share blue sub-pixels so as to display the whole image.

The present disclosure provides in some embodiments a pixel arrangement structure. Referring to FIGS. 2-5, which are four optional pixel arrangement structures according to some embodiments of the present disclosure, the pixel arrangement structure includes a plurality of repeating units. Each repeating unit includes four pixel units including four red sub-pixels, four green sub-pixels and one blue sub-pixel, and each pixel unit includes one red sub-pixel, one green sub-pixel and ¼ blue sub-pixel. The blue sub-pixel is located at a center region of each repeating unit and surrounded by the red sub-pixels and the green sub-pixels. Each red sub-pixel is adjacent to at least one green sub-pixel and each green sub-pixel is adjacent to at least one red sub-pixel. An area of the ¼ blue sub-pixel is smaller than that of each of the red sub-pixels and the green sub-pixels.

That is, in the above pixel arrangement structure, only the number of the blue sub-pixels is reduced while the number of the red sub-pixels and the green sub-pixels is not reduced, and the arrangement of the three sub-pixels is redesigned so that the plurality of the adjacent red and green sub-pixels may share the blue sub-pixel in the center region of the repeating unit.

In some embodiments of the present disclosure, in each of the repeating units, the red sub-pixels and the green sub-pixels are arranged in two rows and four columns. According to this arrangement, the blue sub-pixel located at the center region of the repeating unit may be surrounded by the red and green sub-pixels uniformly, so as to be shared as needed.

Furthermore, the blue sub-pixel may be arranged at a position corresponding to two middle columns of the four columns, so as to distribute the sub-pixels more uniformly and achieve a better display effect.

For example, in the pixel arrangement structure shown in FIGS. 2 to 5, the three sub-pixels are arranged in the way described hereinabove. These alternative pixel arrangement structures will be described below with reference to the accompanying drawings, respectively.

Figure 2:
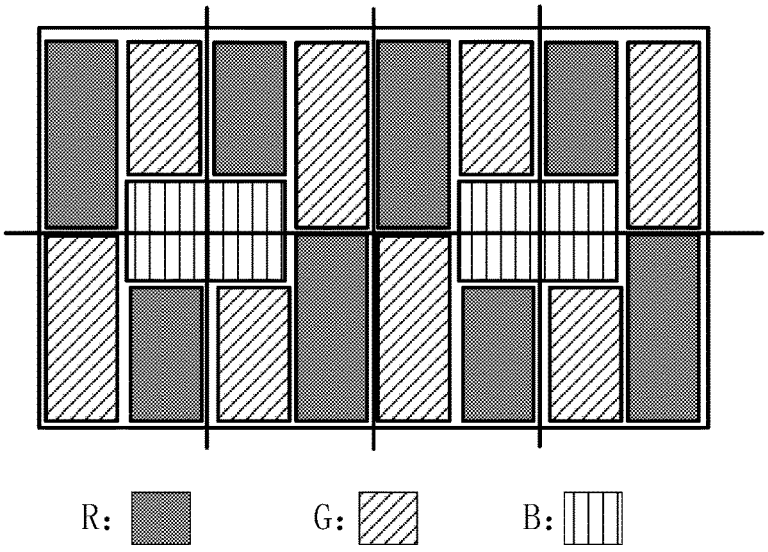
FIG. 2 is a schematic view of a first pixel arrangement structure according to some embodiments of the present disclosure.

FIG. 2 is a schematic view of a first pixel arrangement structure according to some embodiments of the present disclosure. As shown in FIG. 2, in this pixel arrangement structure, the sub-pixels in a first row include, in order, a red sub-pixel, a green sub-pixel, a red sub-pixel and a green sub-pixel; and the sub-pixels in a second row include, in order, a green sub-pixel, a red sub-pixel, a green sub-pixel and a red sub-pixel.

Figure 3:
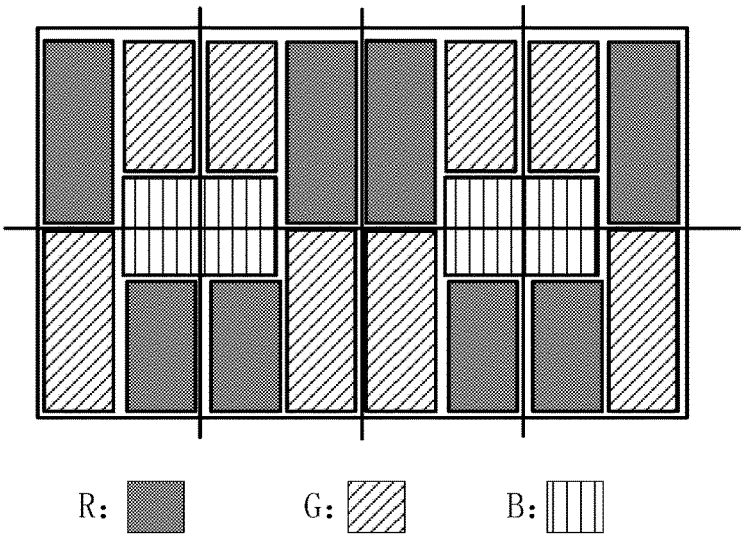
FIG. 3 is a schematic view of a second pixel arrangement structure according to some embodiments of the present disclosure.

FIG. 3 is a schematic view of a second pixel arrangement structure according to some embodiments of the present disclosure. As shown in FIG. 3, in this pixel arrangement structure, the sub-pixels in a first row include, in order, a red sub-pixel, a green sub-pixel, a green sub-pixel and a red sub-pixel; and the sub-pixels in a second row include, in order, a green sub-pixel, a red sub-pixel, a red sub-pixel and a green sub-pixel.

Figure 4:
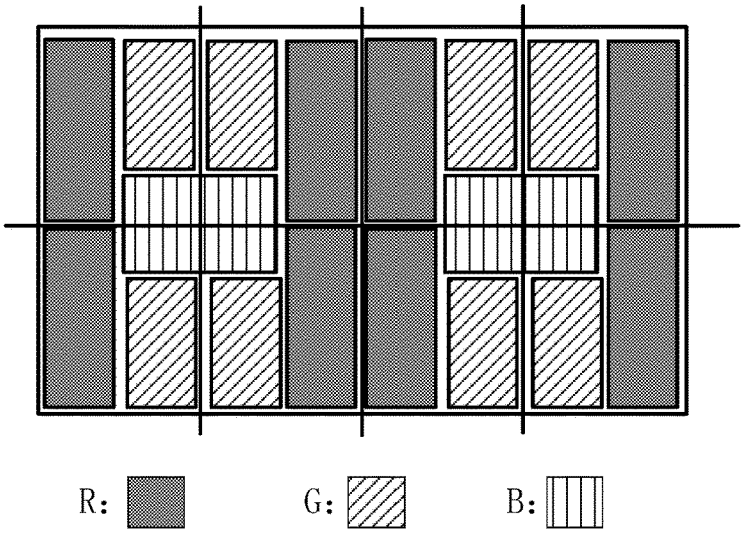
FIG. 4 is a schematic view of a third pixel arrangement structure according to some embodiments of the present disclosure.

FIG. 4 is a schematic view of a third pixel arrangement structure according to some embodiments of the present disclosure. As shown in FIG. 4, in this pixel arrangement structure, the sub-pixels in a first row include, in order, a red sub-pixel, a green sub-pixel, a green sub-pixel and a red sub-pixel; and the sub-pixels in a second row include, in order, a red sub-pixel, a green sub-pixel, a green sub-pixel and a red sub-pixel.

Figure 5:
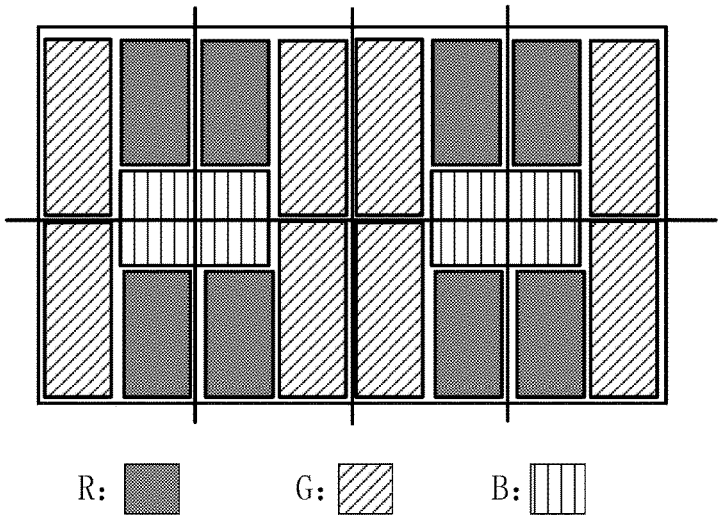
FIG. 5 is a schematic view of a fourth pixel arrangement structure according to some embodiments of the present disclosure.

FIG. 5 is a schematic view of a fourth pixel arrangement structure according to some embodiments of the present disclosure. As shown in FIG. 5, in this pixel arrangement structure, the sub-pixels in a first row include, in order, a green sub-pixel, a red sub-pixel, a red sub-pixel and a green sub-pixel; and the sub-pixels in a second row include, in order, a green sub-pixel, a red sub-pixel, a red sub-pixel and a green sub-pixel.

In some embodiments of the present disclosure, the red sub-pixel and the green sub-pixel in each pixel unit may form an L-shaped sub-pixel group. Of course, the L-shaped sub-pixel group is merely a concept defined to facilitate the description of the combined arrangement of the red sub-pixels and the green sub-pixels. In FIGS. 2 to 5, the blue sub-pixel is located at the central region of the repeating unit. In each pixel unit of the repeating unit, the L-shaped structure formed by the red and green sub-pixels is arranged adjacent to two adjacent sides of the ¼ blue sub-pixel. With such an arrangement, the red sub-pixels and the green sub-pixels may be closely arranged around the blue sub-pixel which functions as a common sub-pixel.

Furthermore, in each L-shaped sub-pixel group, a length of one sub-pixel in a column direction is equal to a sum of a length of the other sub-pixel in a column direction, a length of the ¼ blue sub-pixel in the column direction and a distance between the other sub-pixel and the ¼ blue sub-pixel in the column direction.

It should be noted that, since the repeating units shown in the pixel arrangement structure in FIGS. 2 to 5 are each composed of four pixel units consisting of the L-shaped sub-pixel groups and the shared sub-pixel (i.e., the blue sub-pixel), it is able to fully utilize the space between the pixel units thereby ensuring the physical space utilization ratio.

The present disclosure further provides in some embodiments an array substrate including the above pixel arrangement structure, the detailed description of which will be omitted herein since it has the same improvement of the pixel arrangement structure discussed above.

The present disclosure further provides in some embodiments a display apparatus, including the above array substrate, the detailed description of which will be omitted herein.

Figure 6:
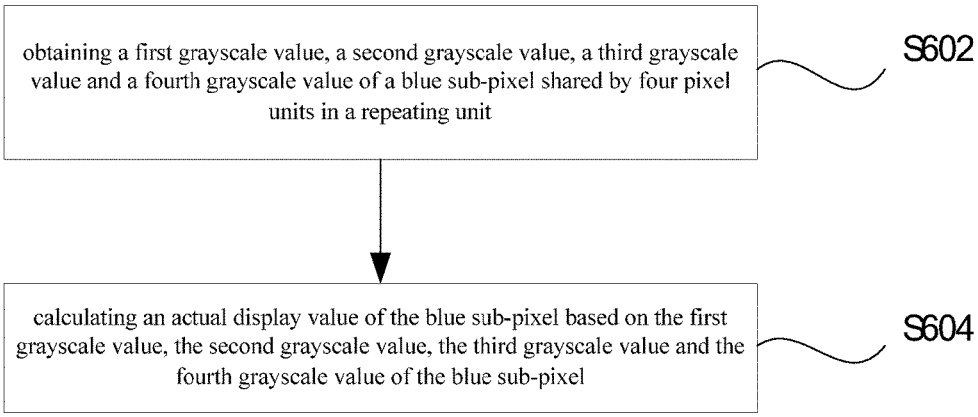
FIG. 6 is a flow chart showing a display control method according to some embodiments of the present disclosure.

Corresponding to the above pixel arrangement structure, the present disclosure further provides in some embodiments a display control method. FIG. 6 is a flow chart showing the display control method according to some embodiments of the present disclosure. As shown in FIG. 6, the method includes the following steps (Step S602-Step S604).

Step S602, obtaining a first grayscale value, a second grayscale value, a third grayscale value and a fourth grayscale value of a blue sub-pixel shared by four pixel units in a repeating unit.

Step S604, calculating an actual display value of the blue sub-pixel based on the first grayscale value, the second grayscale value, the third grayscale value and the fourth grayscale value of the blue sub-pixel.

In the embodiments, the step S604 may include calculating an average grayscale value of the first grayscale value, the second grayscale value, the third grayscale value and the fourth grayscale value of the blue sub-pixel as the actual display value thereof.

That is, for each repeating unit, the red sub-pixels and the green sub-pixels in the four pixel units are respectively set to the gray scale values actually required for displaying an image. For the entire display image, the gray scale values of the blue color to be displayed for respective pixel units are different. However, the four sub-pixel units share only one blue sub-pixel unit. The blue sub-pixel may only be set to one gray-scale value, therefore, for four pixel units, it is best to set the shared blue sub-pixel to the average gray scale value of the blue color to be displayed. Based on this, the first gray-scale value, the second gray-scale value, the third gray-scale value, and the fourth gray-level value of the blue sub-pixel, which are originally required in the four pixel units respectively, are weighted-averaged to obtain the average grayscale value of the blue sub-pixel as the actual input to the shared blue sub-pixel. In this way, the gray-scale value of the blue sub-pixel may be acceptable for the four pixel units and is closest to the four gray-scale values that are originally required in the four pixel units respectively.

According to some embodiments of the present disclosure, the number of blue sub-pixels can be reduced and the adjacent red and the green sub-pixels share the blue sub-pixel to display a whole image. Since the HVS is the least insensitive to the blue sub-pixel, the visual perception of the observer will not be affected, thereby displaying an image of same quality by using a smaller number of physical sub-pixels without lowering the display quality of the image.

The above are merely the preferred embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

What is claimed is:

1. A pixel arrangement structure, comprising a plurality of repeating units, wherein each repeating unit comprises four pixel units comprising four red sub-pixels, four green sub-pixels and one blue sub-pixel, and each pixel unit comprises one red sub-pixel, one green sub-pixel and ¼ blue sub-pixel, wherein the blue sub-pixel is located at a center region of each repeating unit and surrounded by the red sub-pixels and the green sub-pixels;

each red sub-pixel is adjacent to at least one green sub-pixel and each green sub-pixel is adjacent to at least one red sub-pixel; and an area of the ¼ blue sub-pixel is smaller than that of each of the red sub-pixels and the green sub-pixels; wherein in each of the repeating units, the red sub-pixels and the green sub-pixels are arranged in two rows and four columns;

the blue sub-pixel is arranged at a position corresponding to two middle columns of the four columns;

the sub-pixels in a first row comprise, in order, a red sub-pixel, a green sub-pixel, a red sub-pixel and a green sub-pixel, and the sub-pixels in a second row comprise, in order, a green sub-pixel, a red sub-pixel, a green sub-pixel and a red sub-pixel;

the red sub-pixel and the green sub-pixel in each pixel unit form an L-shaped sub-pixel group;

the L-shaped sub-pixel group of each pixel unit is arranged adjacent to two adjacent sides of the ¼ blue sub-pixel; and the blue sub-pixel is located within a region enclosed by the L-shaped sub-pixel groups of the four pixel units of each repeating unit.

2. The pixel arrangement structure according to claim 1, wherein in each L-shaped sub-pixel group, a length of one sub-pixel in a column direction is equal to a sum of a length of the other sub-pixel in a column direction, a length of the ¼ blue sub-pixel in the column direction and a distance between the other sub-pixel and the ¼ blue sub-pixel in the column direction.

3. An array substrate, comprising the pixel arrangement structure according to claim 1.

4. A display apparatus, comprising the array substrate according to claim 3.

5. A display control method applied to the pixel arrangement structure according to claim 1, comprising steps of:

obtaining a first grayscale value, a second grayscale value, a third grayscale value and a fourth grayscale value of a blue sub-pixel shared by four pixel units in a repeating unit; and calculating an actual display value of the blue sub-pixel based on the first grayscale value, the second grayscale value, the third grayscale value and the fourth grayscale value of the blue sub-pixel.

6. The display control method according to claim 5, wherein the step of calculating an actual display value of the blue sub-pixel based on the first grayscale value, the second grayscale value, the third grayscale value and the fourth grayscale value comprises:

calculating an average grayscale value of the first grayscale value, the second grayscale value, the third grayscale value and the fourth grayscale value as the actual display value of the blue sub-pixel.

* * * * *